US007131954B2

(12) United States Patent
Liao

(10) Patent No.: US 7,131,954 B2
(45) Date of Patent: Nov. 7, 2006

(54) MASSAGING WHEEL ASSEMBLY

(76) Inventor: Bi-Chih Liao, 4F., No. 272, Sec. 4, Chengde Rd., Shihlin District, Taipei City 111 (TW)

( * ) Notice: Subject to any disclaimer, the term of this patent is extended or adjusted under 35 U.S.C. 154(b) by 128 days.

(21) Appl. No.: 11/023,375

(22) Filed: Dec. 29, 2004

(65) Prior Publication Data

US 2005/0148912 A1 Jul. 7, 2005

(30) Foreign Application Priority Data

Jan. 4, 2004 (TW) ..... 93200050 U

(51) Int. Cl.
*A61H 15/00* (2006.01)

(52) U.S. Cl. ..... 601/99; 601/102; 601/103; 601/116

(58) Field of Classification Search ..... 601/97, 601/98, 99, 100–103, 112, 113, 115, 116, 601/118, 122, 130, 134
See application file for complete search history.

(56) References Cited

U.S. PATENT DOCUMENTS

| | | | | |
|---|---|---|---|---|
| 6,071,252 | A * | 6/2000 | Marcantoni | 601/99 |
| 6,409,689 | B1 * | 6/2002 | Chen | 601/99 |
| 6,623,438 | B1 * | 9/2003 | Wu | 601/99 |
| 6,790,190 | B1 * | 9/2004 | Marcantoni | 601/99 |
| 6,808,500 | B1 * | 10/2004 | Cheng-Yi et al. | 601/99 |

* cited by examiner

*Primary Examiner*—Quang D. Thanh
(74) *Attorney, Agent, or Firm*—Troxell Law Office, PLLC

(57) ABSTRACT

A massaging wheel assembly is disclosed to include two base frames pivotally connected in parallel to a sliding carrier slidably movable in a sliding track, each base frame having a wheel axle at the front end and a pivot pin at the rear end, two supplementary frames respectively pivoted to the pivot pins at the rear ends of the base frames, each supplementary frame having two wheel axles at the ends, two main massaging wheels respectively pivoted to the wheel axles at the front ends of the base frames, and four supplementary massaging wheels respectively pivoted to the wheel axles at the ends of the supplementary frames.

4 Claims, 3 Drawing Sheets

MASSAGING WHEEL ASSEMBLY

BACKGROUND OF THE INVENTION

1. Field of the Invention

The present invention relates to a massaging wheel assembly for use in a massaging chair or the like for massaging the back of a person and more particularly, to such a massaging wheel assembly, which is effective to massage the user's back and shoulders as well as the user's neck.

2. Description of the Related Art

A variety of massaging apparatus have been disclosed and have appeared on the market. These massaging apparatus are designed for rubbing and kneading the muscles and joints of different parts of the body in order to make them work better.

Conventional massaging apparatus for massaging a person's back commonly use a massaging wheel assembly to achieve the massaging function. Similar designs are seen in Taiwan patent no. 091207789 entitled "Chain drive roller massager sliding positioning structure"; no. 89215673 entitled "Unitary roller driving mechanism for electric roller massager and electric roller massager using same".

The aforesaid roller massagers commonly comprise pivoted frame bars and massaging rollers pivotally mounted on the ends of the pivoted frame bars. These roller massagers are functional, however they can only massage the user's back and shoulders, not reachable to the user's neck. Further, the massaging action is monotonous.

SUMMARY OF THE INVENTION

The present invention has been accomplished under the circumstances in view. It is the main object of the present invention to provide a massaging wheel assembly, which is effective to massage the user's back and shoulders as well as the user's neck. To achieve this and other objects of the present invention, the massaging wheel assembly comprises two base frames, two supplementary frames, two main massaging wheels, and four supplementary massaging wheels. The base frames are pivotally connected in parallel to a sliding carrier slidably movable in a sliding track. Each base frame has a wheel axle at the front end and a pivot pin at the rear end. The supplementary frames are respectively pivoted to the pivot pins at the rear ends of the base frames, each having two wheel axles at the ends. The main massaging wheels are respectively pivoted to the wheel axles at the front ends of the base frames. The supplementary massaging wheels are respectively pivoted to the wheel axles at the ends of the supplementary frames.

DETAILED DESCRIPTION OF THE PREFERRED EMBODIMENT

Figure 1:
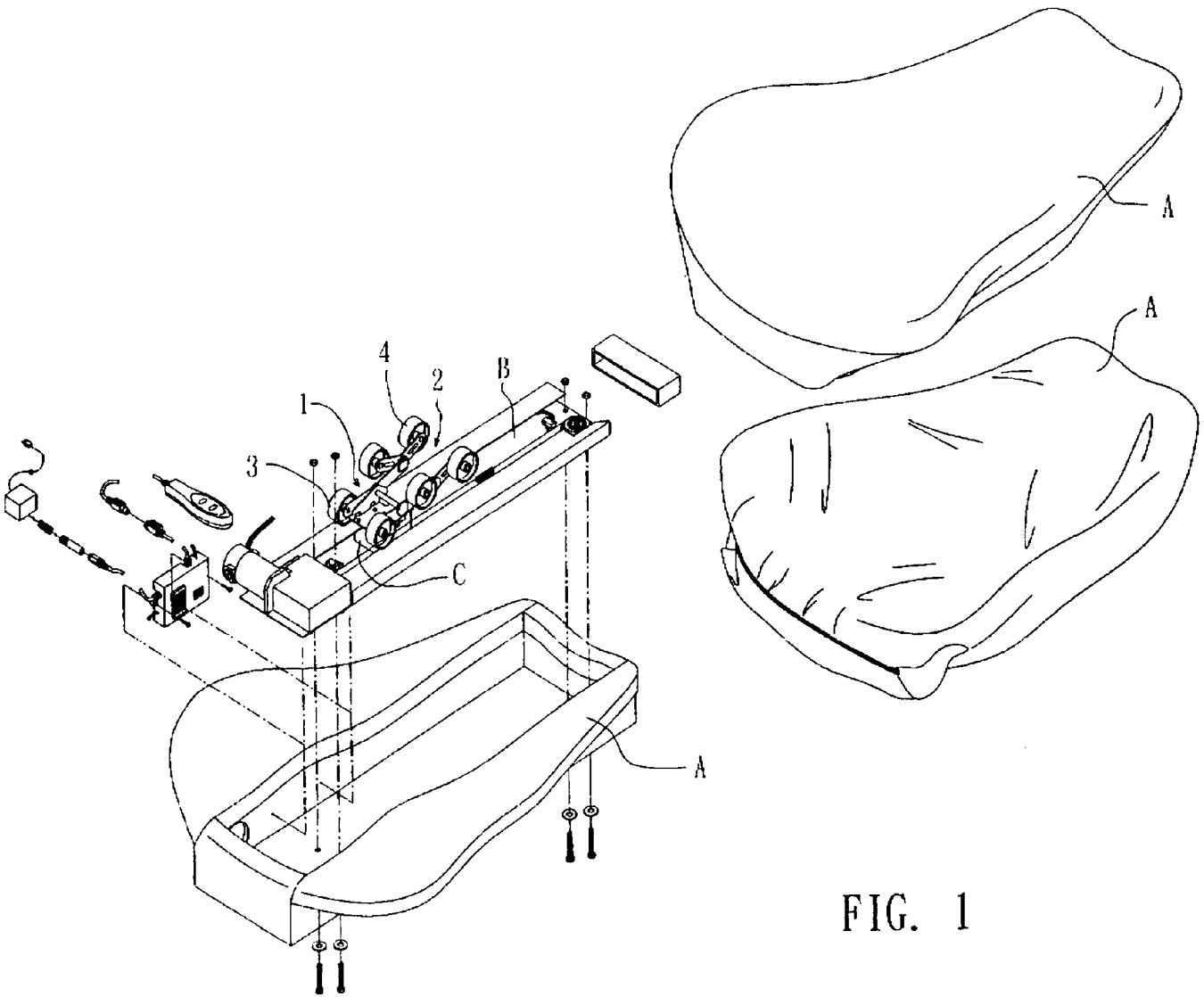
FIG. 1 is an exploded view of a back massager constructed according to the present invention.

Referring to FIG. 1, a back massager is shown comprising a sliding track B, a sliding carrier C slidably coupled to the sliding track B, a massaging wheel assembly carried on the sliding carrier C, and soft cover members A wrapped the sliding track B, the sliding carrier C and the massaging wheel assembly.

Figure 2:
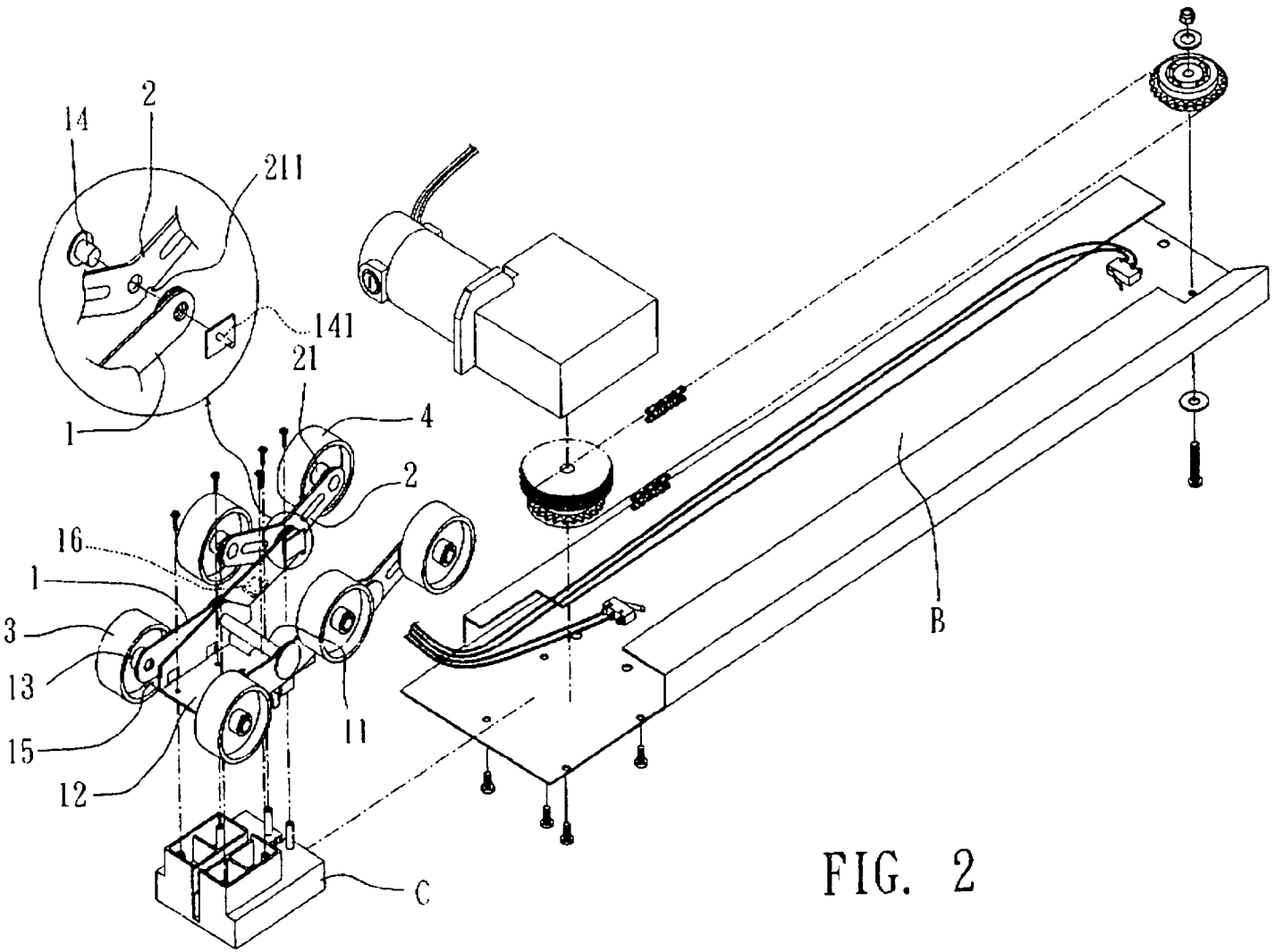
FIG. 2 is an exploded view of a massaging wheel assembly according to the present invention.
Figure 3:
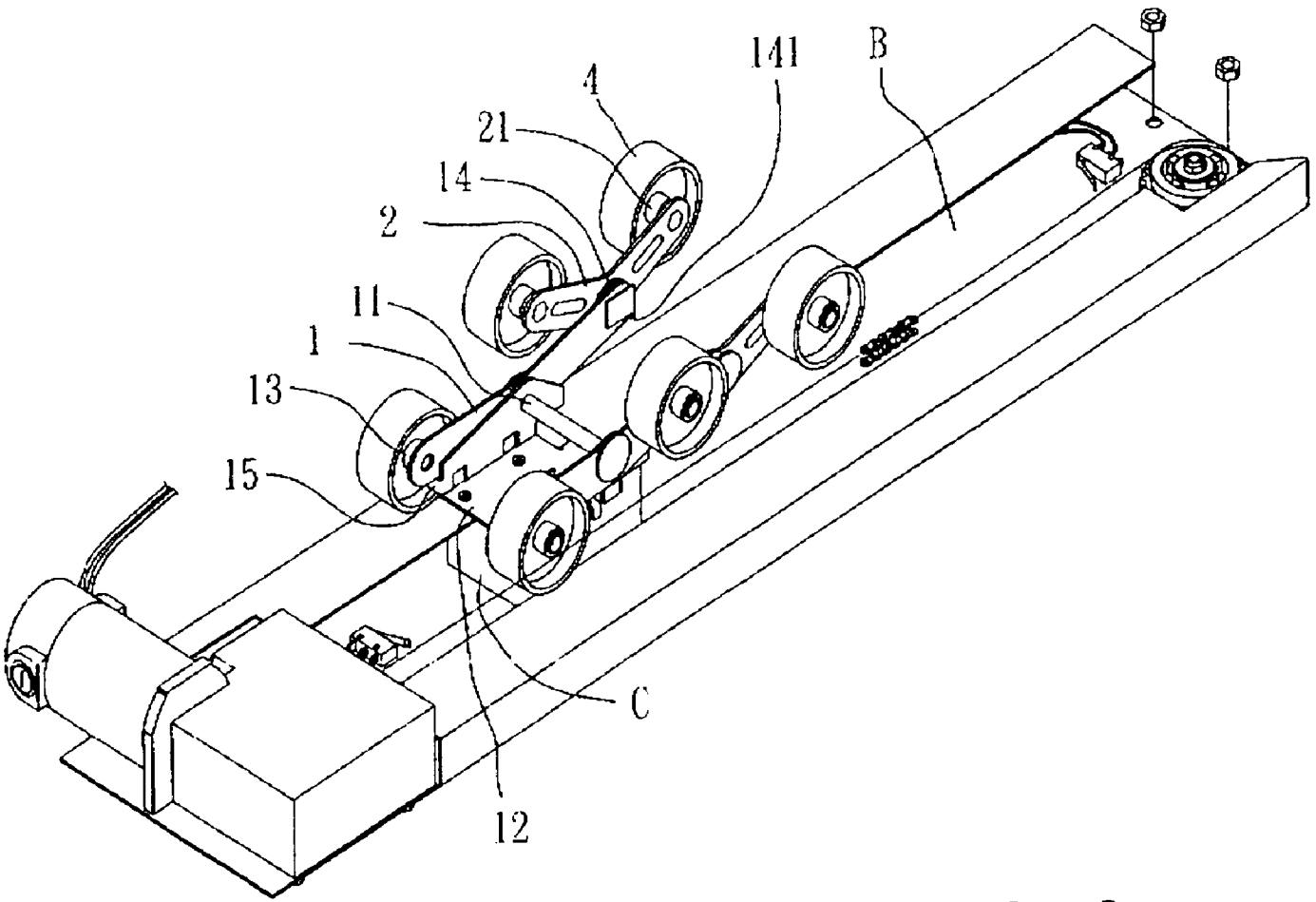
FIG. 3 is an assembly view of the massaging wheel assembly shown in FIG. 2.

Referring to FIGS. 2 and 3, the aforesaid massaging wheel assembly comprises two base frames 1 arranged in parallel, two supplementary frames 2 respectively pivoted to the rear ends of the base frames 1, two main massaging wheels 3 respectively pivotally mounted in the front ends of the base frames 1, and two pairs of supplementary massaging wheels 4 respectively pivotally mounted in the two ends of each of the supplementary frames 2.

The base frames 1 are flat elongated frame bars pivotally connected in parallel by a pivot 11. A mounting member 12 is coupled to the pivot 11 for fastening to the sliding carrier C. Each base frame 1 has a wheel axle 13 at the front end for supporting the respective main massaging wheel 3, and a pivot pin 14 at the rear end for supporting the respective supplementary frame 2. Further, each base frame 1 has a protruding portion 15 at the bottom side of the front end for limiting the oscillating angle of the respective base frame 1 relative to the mounting member 12, and a stop flange 16 at the rear end for limiting the oscillating angle of the respective supplementary frame 2 relative to the respective base frame 1. The pivot pin 14 has a protruding portion 141.

The supplementary frames 2 are substantially V-shaped frame bars each having the middle point pivoted to the pivot pin 14 at the rear end of each of the base frames 1, and two wheel axles 21 at the two distal ends for supporting the supplementary massaging wheels 4. The supplementary frames 2 each further have a bottom notch 211 for receiving the protruding portion 141 of the respective pivot pin 14 to limit downward oscillation of the respective supplementary frame 2.

The main massaging wheels 3 are massaging rollers respectively pivotally mounted on the wheel axles 13 at the base frames 1.

The supplementary massaging wheels 4 are massaging rollers respectively pivotally mounted on the wheel axles 21 at the ends of the supplementary frames 2.

Referring to FIG. 3 again, after installation of the massaging wheel assembly in the sliding carrier C at the sliding track B, the massaging wheel assembly can be moved with the sliding carrier C along the sliding track B, and the wheels 3 and 4 are respectively rotatably moved with the base frames 1 and the supplementary frames 2 relative to the sliding carrier C.

When the user pressed the back against the sliding wheel assembly (that is installed in the back of a chair), the supplementary frames 2 are oscillated relative to the base frames 1, and the supplementary massaging wheels 4 are rotated relative to the supplementary frames 2 and moved with the supplementary frames 2 to massage the user's back and shoulders as well as the user's neck.

A prototype of massaging wheel assembly has been constructed with the features of FIGS. 1~3. The massaging wheel assembly functions smoothly to provide all of the features discussed earlier.

Although a particular embodiment of the invention has been described in detail for purposes of illustration, various modifications and enhancements may be made without departing from the spirit and scope of the invention.

What the invention claimed is:

1. A massaging wheel assembly comprising:

two base frames pivotally connected in parallel to a sliding carrier slidably movable in a sliding track, said base frames each having a wheel axle at a front end thereof and a pivot pin at a rear end thereof;

two supplementary frames respectively pivoted to the pivot pins at the rear ends of said base frames with a respective middle part thereof, said supplementary frames each having two wheel axles at two ends thereof;

two main massaging wheels respectively pivoted to the wheel axles at the front ends of said base frames; and four supplementary massaging wheels respectively pivoted to the wheel axles at the ends of said supplementary frames.

2. The massaging wheel assembly as claimed in claim 1, further comprising a mounting frame fixedly fastened to said sliding carrier for pivotally supporting said base frames.

3. The massaging wheel assembly as claimed in claim 1, wherein said main massaging wheels and said supplementary massaging wheels have a same size.

4. The massaging wheel assembly as claimed in claim 1, wherein said base frames each have a first stop means at the front end thereof at a bottom side for limiting the turning angle of the respective base frame relative to said sliding carrier, a second stop means at the rear end thereof for limiting the turning angle of the respective supplementary frame relative to the respective base frame; the pivot pins at the rear ends of said base frame each have a protruding portion; said supplementary frames each have a bottom notch for receiving the protruding portion of the respective pivot pin to limit downward oscillation of the respective supplementary frame.

* * * * *